United States Patent [19]

Savage et al.

[11] Patent Number: 4,867,584

[45] Date of Patent: Sep. 19, 1989

[54] IMPACT MECHANISM FOR IMPACT PRINTER

[75] Inventors: James G. Savage, Newark; Brian E. Jagger, Pleasanton; Tjado V. Namen, Danville, all of Calif.

[73] Assignee: Xerox Corporation, Stamford, Conn.

[21] Appl. No.: 206,554

[22] Filed: Jun. 14, 1988

[51] Int. Cl.[4] ..... B41J 9/36

[52] U.S. Cl. ..... 400/157.3; 400/144.2; 400/356; 400/174; 400/354.3; 101/93.31; 101/93.48

[58] Field of Search ..... 400/59, 144.2, 94, 248, 400/174, 175, 356, 354.3, 63, 144.3, 157.1, 157.2, 370, 375.3, 376, 157.3; 101/93.48, 93.15, 93.16, 93.17, 93.31

[56] References Cited

U.S. PATENT DOCUMENTS

| | | | |
|---|---|---|---|
| 4,023,662 | 5/1977 | Perucca | 400/59 X |
| 4,086,997 | 5/1978 | Wu | 400/59 X |
| 4,652,153 | 3/1987 | Kotsuzumi et al. | 400/59 X |
| 4,657,415 | 4/1987 | Kikuchi et al. | 400/59 |
| 4,668,112 | 5/1987 | Gabor et al. | 400/144.2 X |
| 4,678,355 | 7/1987 | Gabor et al. | 400/144.2 X |
| 4,681,469 | 7/1987 | Gabor | 400/144.2 X |
| 4,737,043 | 4/1988 | Gabor et al. | 101/93.48 X |

FOREIGN PATENT DOCUMENTS

| | | | |
|---|---|---|---|
| 3322791 | 1/1985 | Fed. Rep. of Germany | 400/144.2 |
| 176189 | 10/1982 | Japan | 400/144.2 |
| 149387 | 7/1986 | Japan | 400/59 |

*Primary Examiner*—Edgar S. Burr
*Assistant Examiner*—James R. McDaniel
*Attorney, Agent, or Firm*—Serge Abend

[57] ABSTRACT

An impact mechanism for use in an impact printer, to deliver a printing force to drive a character element against a platen by means of a print tip movable toward and away from the platen. A rockable bail bar having an axis of rotation substantially parallel to the axis of the platen is constrained to limited angular movement toward and away from the platen by a prime mover connected to the bail bar. A push rod interconnects the print tip and the bail bar for delivering impact forces to the platen as the bail bar is moved toward the platen. The push rod is normally of a first length and rigid delivering impact forces to the platen and is collapsible to a second length, shorter than the first length, for drawing the print tip away from the platen so as to allow the character element to be removed. A collapsing mechanism is provided to convert the push rod from the first length to the second length.

9 Claims, 8 Drawing Sheets

IMPACT MECHANISM FOR IMPACT PRINTER

FIELD OF THE INVENTION

This invention relates to an impact mechanism for an improved serial impact printer and, more particularly, to the push rod portion thereof which is collapsible for allowing access to a print wheel. The novel impact printer in which the present mechanism is employed is designed to substantially reduce impact noise generation during the printing operation.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by the technical community to reduce the noise pollution. Some of these methods include enclosing impact printers in sound attenuating covers, designing impact printers in which the impact noise is reduced, and designing quieter printers based on non-impact technologies such as ink jet and thermal transfer.

Noise measurements are often referenced as dBA values. The "A" scale, by which the sound values have been identified, represents humanly perceived levels of loudness as opposed to absolute values of sound intensity. When considering sound energy represented in dB (or dBA) units, it should be borne in mind that the scale is logarithmic and that a 10 dB difference means a factor of 10, a 20 dB difference means a factor of 100, 30 dB a factor of 1000, and so on.

Typically, impact printers generate impact noise in the range of 65 to just over 80 dBA, which is deemed to be intrusive. When reduced to the high 50s dBA, the noise is construed to be objectionable or annoying. It would be highly desirable to reduce the impact noise to a dBA value in the vicinity of 50 dBA. For example, the IBM Selectric ball unit typewriters generate about 78 dBA, while the Xerox Memorywriter typewriters generate about 68 dBA. The typewriter of the present invention has been typically measured at slightly less than 52 dBA. This represents a dramatic improvement on the order of about 100 times less noisy than present day offices, a notable achievement toward a less stressful office environment.

Although the printing impact, produced as the hammer impacts and drives the type character pad against the ribbon, the print sheet and the platen with sufficient force to release the ink from the ribbon, is the major source of noise in the typewriter, other noise sources are present. In the presently available typewriters, the impact noise overshadows the other noises. But, once the impact noise has been substantially reduce, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

In conventional ballistic hammer impact printers a hammer mass of about 2.5 grams is driven ballistically by a solenoid-actuated clapper toward the ribbon/-paper/platen combination. When the hammer hits the rear surface of the character pad it drives it against the ribbon/paper/platen combination and deforms the platen which, when it has absorbed the hammer impact energy, seeks to return to its nornmal shape by driving the hammer back to its home position where it must be stopped, usually by another impact. This series of impacts is the main source of the objectionable noise. Looking solely at the platen deformation impact portion of the hammer movement, the total dwell time is typically in the vicinity of 100 microseconds. At a printing speed of 30 characters per second, the mean time available between character impacts is about 30 milliseconds. The impact noise reduction achieved by the printing mechanism of the present typewriter is made possible by significantly stretching the impact dwell time to a substantially larger fraction of the printing cycle than is typical in conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved.

The general concept implemented in the present typewriter, i.e. reduction in impulse noise achieved by stretching the deformation pulse, has been recognized for many decades. As long ago as 1918, in U.S. Pat. No. 1,261,751 (Anderson) it was recognized that quieter operation of the printing function in a typewriter may be achieved by increasing the "time actually used in making the impression". A type bar typewriter operating upon the principles described in this patent was commercially available at that time.

RELATED PATENTS AND APPLICATIONS

The quiet impact printing mechanism incorporating the present invention is described, and its theory of operation is explained in the following commonly assigned patents any one of whose disclosures are herein fully incorporated by reference. U.S. Pat. No. 4,668,112 (Gabor et al), entitled "Quiet Impact Printer", relates to the manner in which the impact force in a printer of this type is controlled; U.S. Pat. No. 4,673,305 (Crystal), entitled "Printwheel For Use in a Serial Printer", relates to a printwheel modified for quiet operation when used with an alignment member; U.S. Pat. No. 4,678,355 (Gabor et al) entitled "Print Tip Contact Sensor for Quiet Compact Printer", relates to an impacting element having a sensor thereon for signaling initiation of impact; U.S. Pat. No. 4,681,469 (Gabor), entitled "Quiet Impact Printer", relates to the high mass, prolonged contact period parameters of a printer of this type; U.S. Pat. No. 4,686,900 (Crystal et al), entitled "Impact Printer With Application of Oblique Print Force", relates to a shear inducing impacting element; and U.S. Pat. No. 4,737,043 (Gabor et al), entitled "Impact Mechanism for Quiet Impact Printer", relates to the unique prime mover and high mass print tip driver, including one form of the push rod which is the subject of the present invention.

The present application and two copending applications filed concurrently herewith disclose alternative push rod structures and mechanisms for opening the throat between the closely positioned elemnts of the traversing carriage and the platen so as to allow the operator to manipulate the printwheel in order to remove and replace it. Each copending application is entitled "Impact Mechanism for Impact Printer". One is identified by Ser. No. 206,555, filed on June 14, 1988 and the other by Ser. No. 206,556, filed on June 14, 1988.

It is the primary object of this invention to provide a force transmitting member which will allow a force applying member to be maintained extremely close to the platen, in a force applying zone, during normal operation of the printer and which allows the force applying member to be retracted from the force applying zone for providing access to a character member.

It is another object of this invention to provide a collapsible force transmitting member, or push rod, for connecting a prime mover to a force applying member and capable of delivering printing forces in the range of about 8 to 40 pounds. This push rod must be rigid for force transmission but should be easily collapsible so as to allow the operator to draw the force applying member away from the platen in order to permit access to the printwheel for removal and replacement.

Yet another object of this invention is to provide a collapsible push rod which may be manipulated by the operator without removing the ribbon cartridge from the machine.

SUMMARY OF THE INVENTION

These and other objects may be carried out, in one form, by providing an impact mechanism for use in an impact printer, to deliver a printing force to drive a character element against a platen by means of a print tip normally spaced from the surface of the platen by a throat distance and movable toward and away from the platen. The character element and the print tip are supported upon a carriage mounted upon the printer for reciprocating movement in a path substantially parallel to the axis of the platen. A rockable bail bar having an axis of rotation substantially parallel to the axis of the platen is constrained to limited angular movement toward and away from the platen by a prime mover connected to the bail bar. A push rod interconnects the print tip and the bail bar so as to close the throat distance for delivering an impact force to the platen as the bail bar is moved toward the platen. The push rod is normally of a first length and rigid for delivering impact forces to the platen and is collapsible to a second length, shorter than the first length, for drawing the print tip away from the platen to a distance greater than the throat distance so as to allow the character element to be removed. A collapsing mechanism is provided to convert the push rod from the first length to the second length.

BRIEF DESCRIPTION OF THE DRAWINGS

Other objects and further features and advantages of this invention will be apparent from the following, more particular description considered together with the accompanying drawings, wherein.

DETAILED DESCRIPTION OF THE ILLUSTRATED EMBODIMENTS

Figure 1:
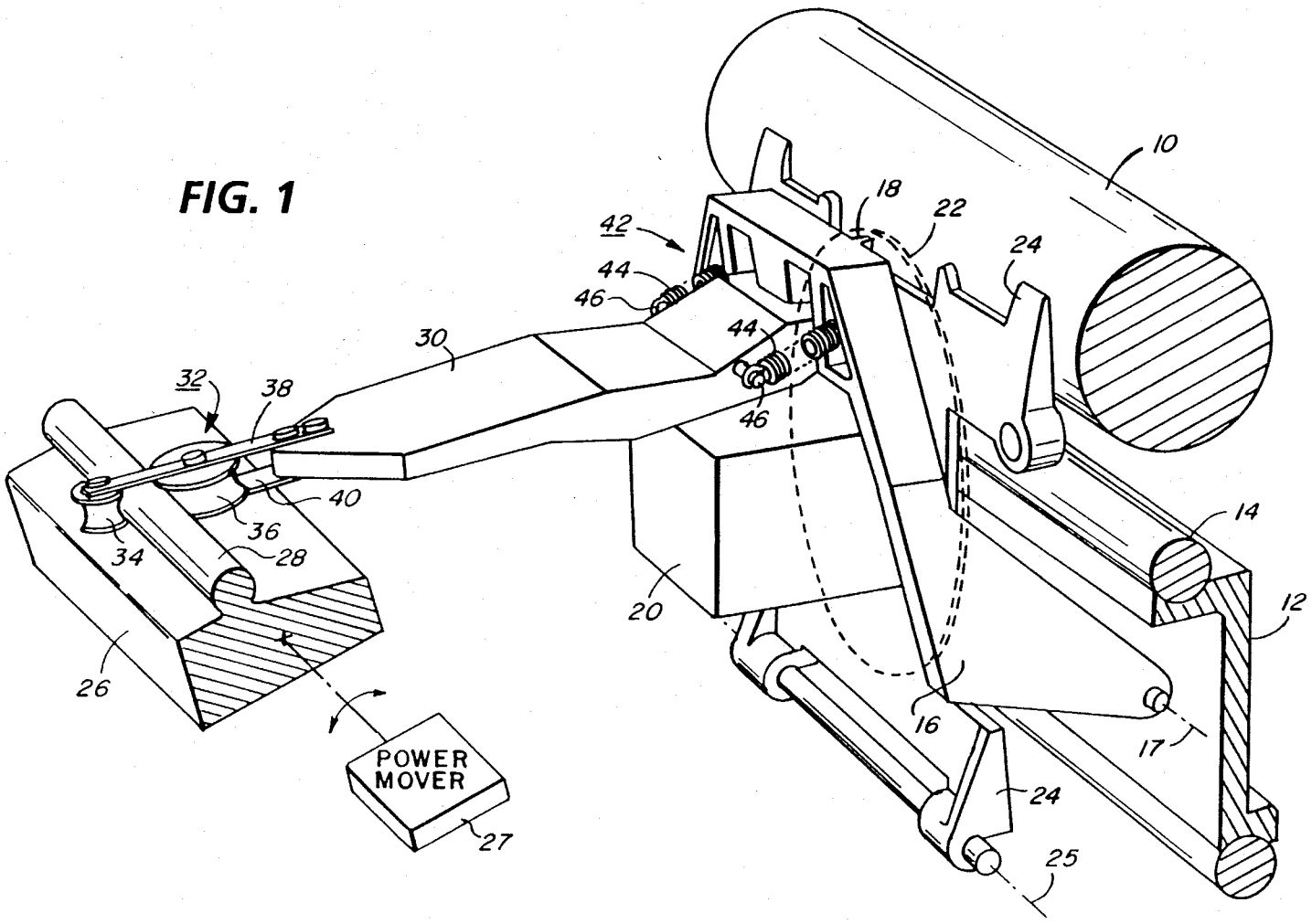
FIG. 1 is a partial perspective view showing the relevant features of a quiet impact printer in which the present invention may be incorporated.
Figure 2:
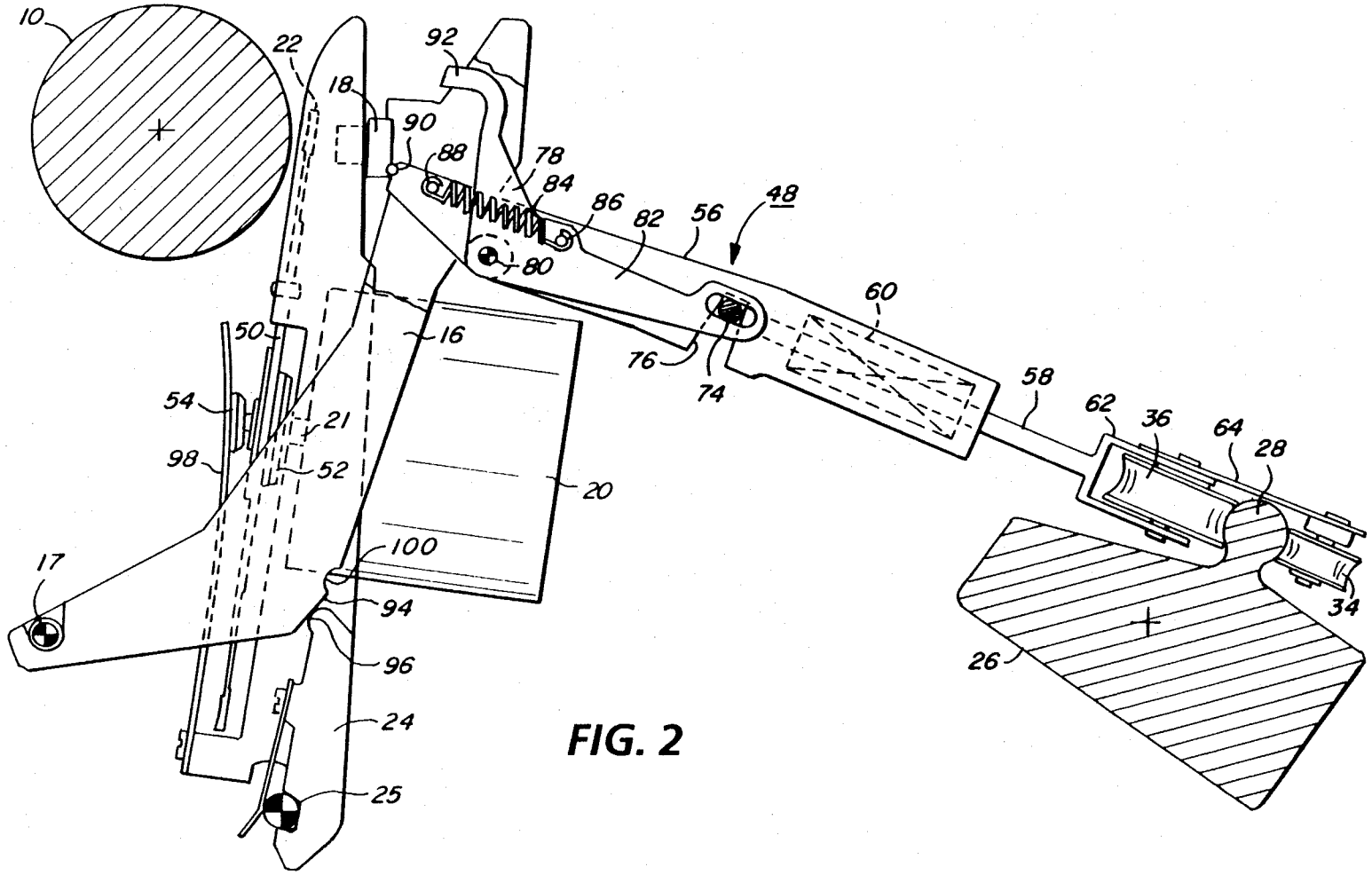
FIG. 2 is a side elevation view showing one form of a collapsible push rod in its extended, force transmitting, position.
Figure 3:
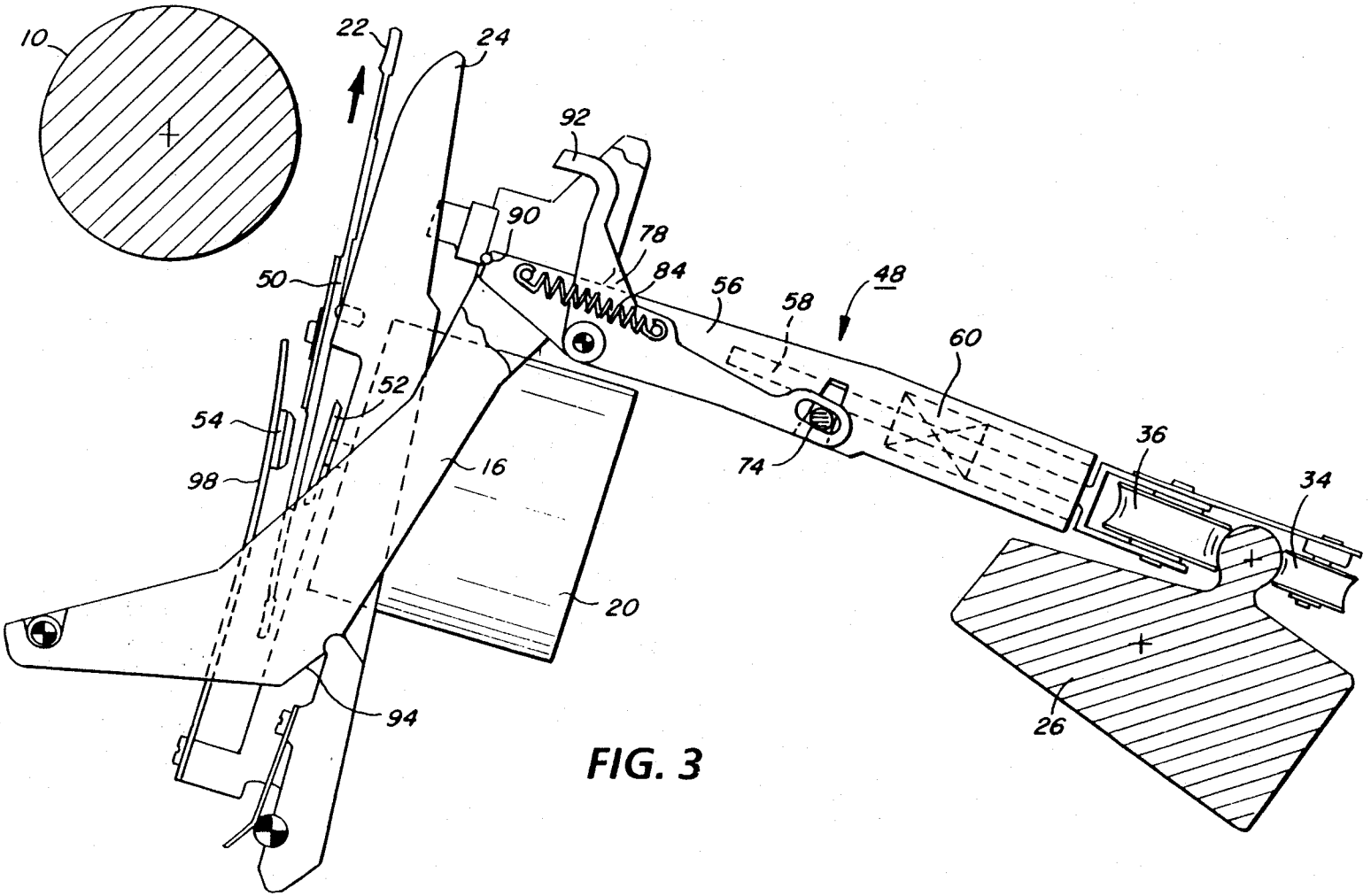
FIG. 3 is a side elevation view similar to FIG. 2 showing the push rod in its collapsed position.
Figure 4A:
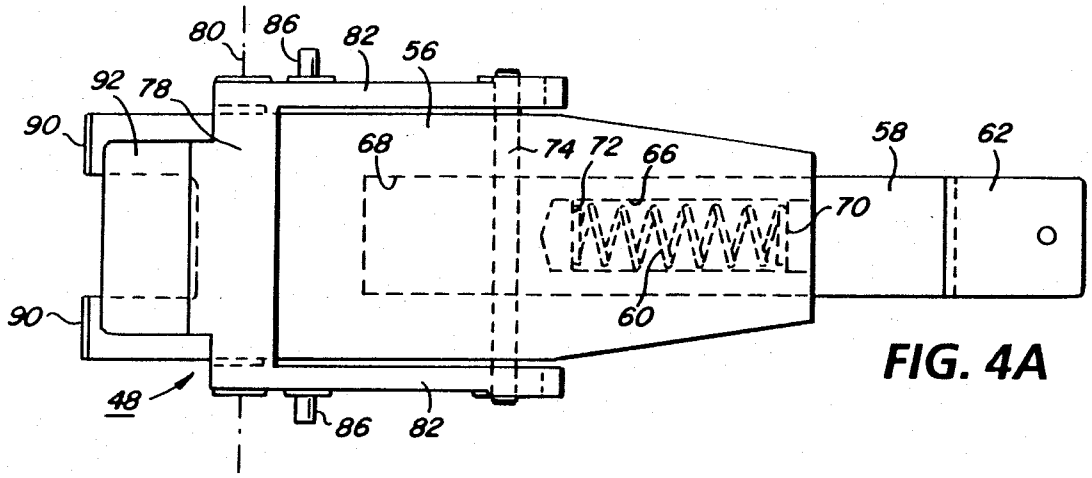
FIG. 4A is a partial top view showing the elements of the collapsible push rod in their extended position.
Figure 4B:
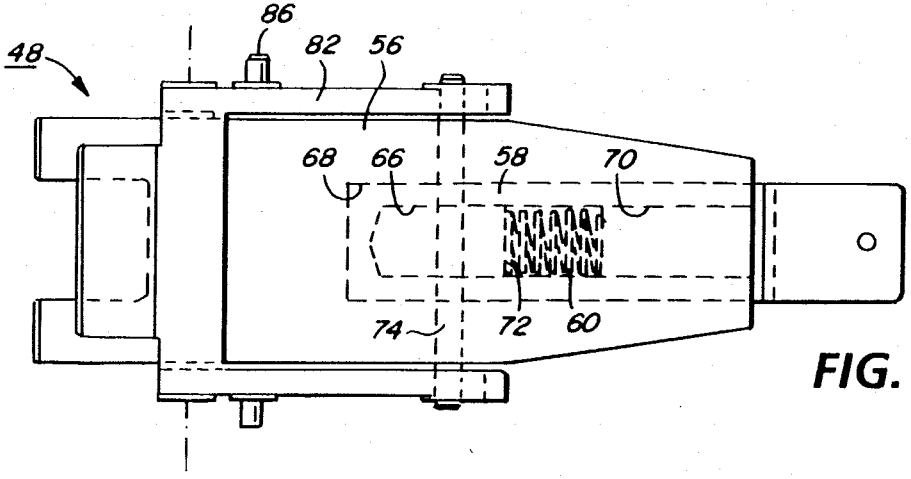
FIG. 4B is a partial top view showing the elements of the collapsible push rod in their collapsed position.
Figure 5:
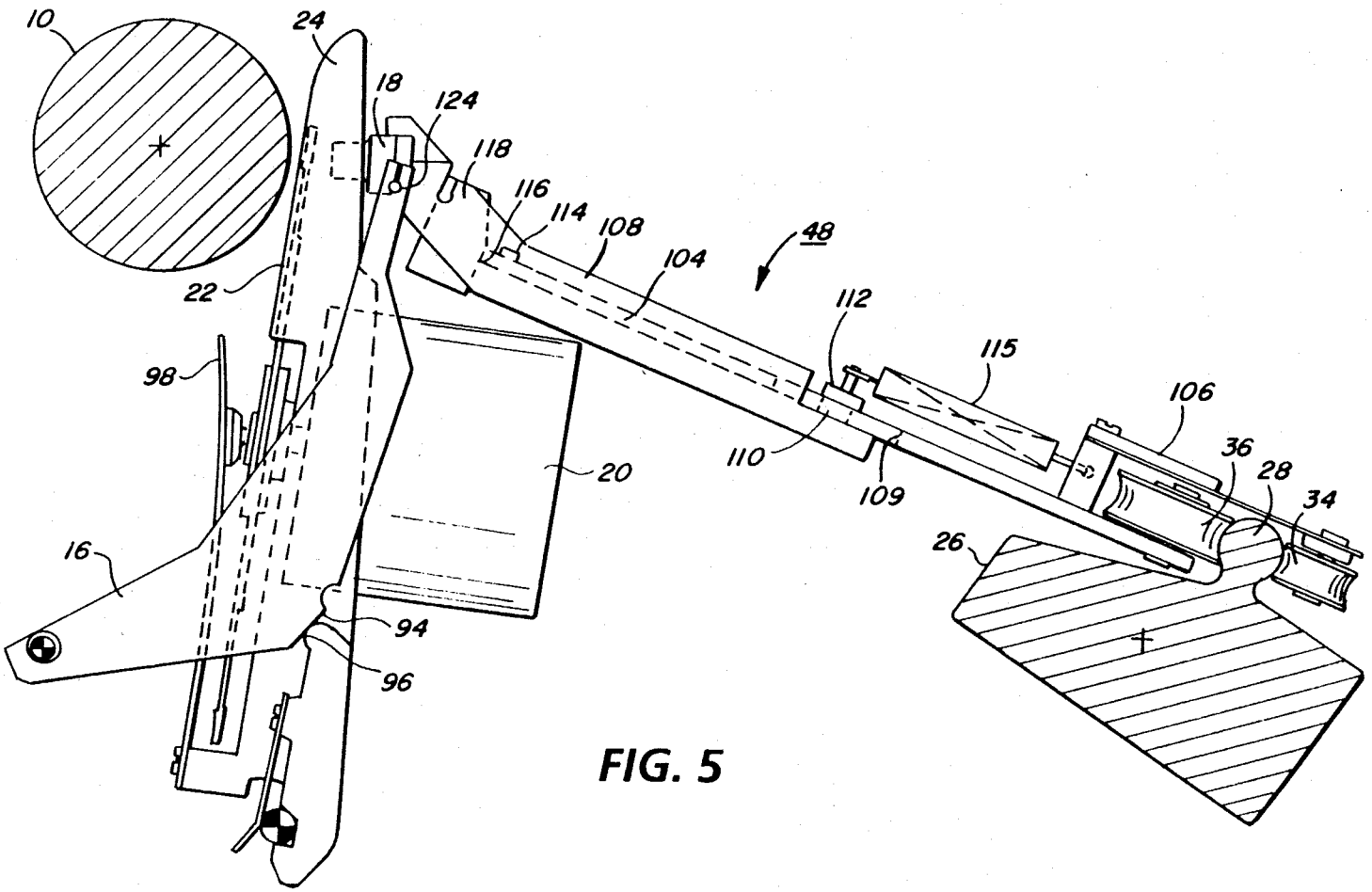
FIG. 5 is a side elevation view showing another form of the collapsible push rod of the present invention, with the push rod in its extended position.
Figure 6:
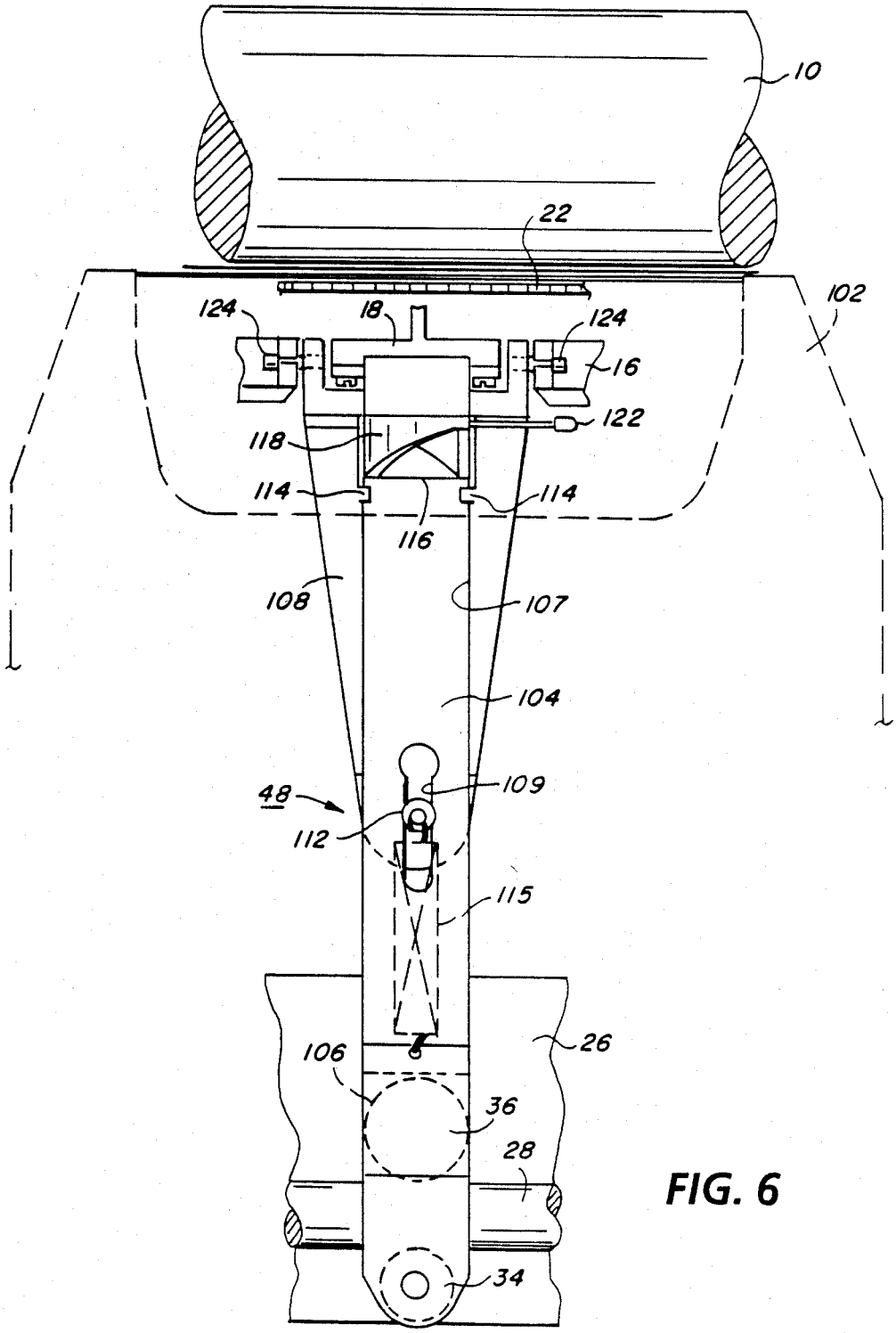
FIG. 6 is a top view of the FIG. 5 embodiment showing the push rod in its extended position.
Figure 7:
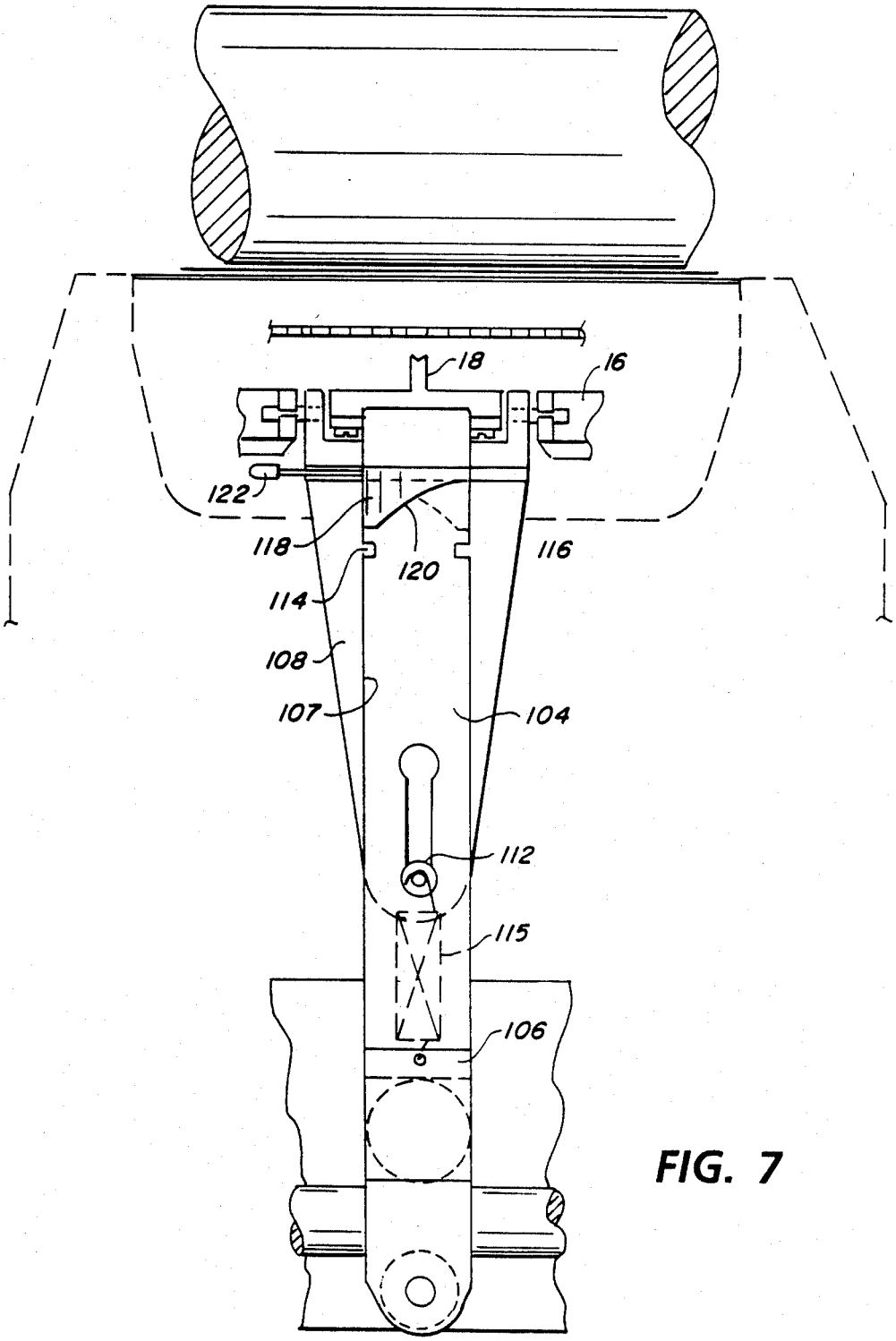
FIG. 7 is a top view of the FIG. 5 embodiment showing the push rod in its collapsed position.
Figure 8A:
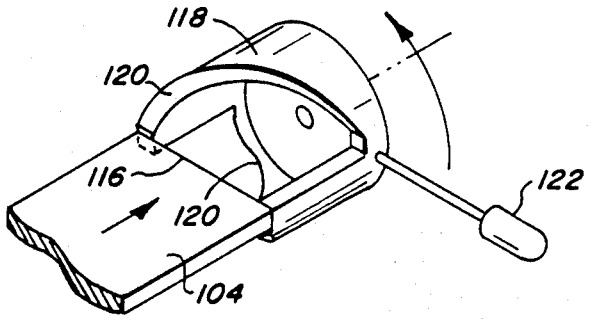
FIGS. 8A and 8B are perspective views of the camming element used in the embodiment of FIGS. 5 to 7.
Figure 8B:
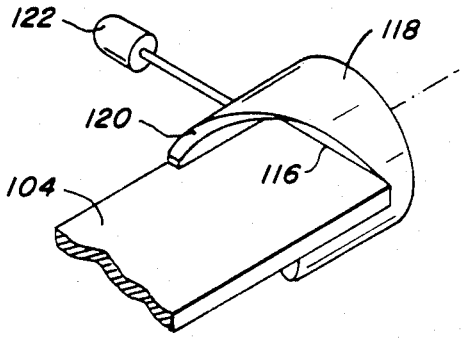

Salient features of the quiet impact printer, in which the present invention is incorporated, are shown in FIG. 1. These include a platen 10 suitably mounted on the frame for rotation to advance and retract an image receptor on which characters may be imprinted. A carriage support beam 12 fitted with rod stock rails 14 spans the printer from side-to-side beneath and parallel to the platen for rigidly and smoothly supporting a carriage (not shown) for traversing movement parallel to the platen. A horseshoe-shaped interposer 16 is mounted upon the carriage for traversing movement therewith. It is mounted for arcuate movement about pivot axis 17 and carries print tip 18 at its apex. A printwheel motor 20 to whose shaft 21 (shown in FIGS. 2 and 3) a printwheel 22 may be secured is also mounted upon the carriage, as is a pivot frame 24 mounted for arcuate movement about pivot axis 25 for automatically controlling the throat adjustment between the print tip 18 and the platen 10 in accordance with the thickness of the image receptor, be it a single sheet of paper, card stock or a multipart form.

A rockable bail bar 26 extending and having an axis of rotation substantially parallel to axis of said platen, is constrained to limited angular movement toward and away from said platen, by a prime mover 27 connected to said bail bar for imparting this rocking movement thereto. The prime mover may be a reciprocating voice coil motor, a rotary motor or any other suitable driver. As the bail bar is rocked, a bead or rail 28 thereon moves a push rod 30 toward and away from the platen. The push rod illustrated in FIG. 1 is a generic form of this element which is rigid and non-collapsible. One end 32 of the push rod rides upon the rail 28 via a pair of capturing rollers 34 and 36 secured to the push rod by upper plate 38 and lower plate 40. The lower plate rigidly supports roller 36 while the upper plate supports both rollers. At least the outer end of the upper plate 38 may be made sufficiently flexible so as to enable the roller 34 to be snapped upon the rail 28 into seating engagement. A bead 41 on the opposite end 42 of the push rod is biased into engagement with a seat on the rear wall of the print tip by means of tension springs 44 extending between pins 46 on the push rod and suitable anchors on the interposer 16. Thus, the drive force of the prime mover 27 is multiplied by the bail bar 26 and is translated to the print tip 18 by the push rod which may pivot about bead 41 so as to enable it to follow the arcuate path prescribed by the interposer 16.

Turning now to FIGS. 2 through 8 there is shown two embodiments of a push rod 48 which is collapsible by the operator for opening the throat between the print tip 18 and the platen 10 so as to allow access to the printwheel 22. It will be noted that as the throat is opened the pivot frame 24 is also drawn back away from the platen and the printwheel hub 50 is released from capture between drive ring 52 and retainer button 54.

In FIGS. 2, 3A, 3B and 4 it can be seen that the push rod 48 comprises two relatively slideable members, a connecting arm 56 and a slider 58, biased apart by compression spring 60. One end of the slider is in the form of a yoke 62 for supporting roller 36, pinned thereto, and carrying roller 34 at the end of a spring arm 64. An elongated opening 66 in the body of the slider receives the spring 60 and together, the slider and the spring are received in the connecting arm 56 within an elongated slot 68 which receives the slider and a cylindrical bore 70 which receives the spring. The bore has an end wall 72 against which the spring is biased, but the slot 68 may extend considerably farther within the connecting arm. As can be seen clearly, the compression spring 60 tends to bias the slider 58 toward the bail bar 26 and the connecting arm 56 toward the interposer 16. The spring will be under a very slight compression in the fully extended position of the push rod.

A latch pin 74 is movable in a transverse slot 76 in the connecting arm, from an upper position in alignment with the end of the slider 58, which is biased against it by compression spring 60, to a lower position out of alignment with the slider. In order to move the latch pin there is provided an L-shaped, pivotable latch arm 78 straddling the connecting arm and affixed thereto for rotation about its axis 80. Each leg 82 of the latch arm has a slotted opening for receiving an end of the latch pin 74. Tension springs 84 connected to pins 86 on the latch arm and to pins 88 (only one shown) on the interposer 16 serve the dual function of urging the latch pin 74 into position to the lock the push rod 48 into its extended, force transmitting position, and biasing pivot beads 90 of the connecting arm 56 against the print tip 18. A handle 92 on the latch arm allows the operator to rotate it about the pivot axis 80 for collapsing the push rod and for returning the push rod to its extended position.

When the operator desires to replace one printwheel with another, the following steps are performed: First, the handle 92 of the latch arm, 78 is assessed between the horns of the ribbon cartridge (not shown, but see FIGS. 6 and 7) which normally overlies the push rod. Next the handle 92 of the latch arm is drawn toward the bail bar 26, causing the latch pin 74 to be dropped beneath the end of the slider 58 and allowing the slider to be moved slightly therepast, toward the interposer 16. Further pulling of the handle moves the connecting arm back along the slider, compressing the spring 60 and drawing the interposer and print tiop 18 away from the platen. As the interposer is moved, a knee 94 thereon contacts a bearing surface 96 on the pivot frame 24, drawing is also away from the platen. Spring arm 98, upon which the retainerbutton 54 is mounted, is normally biased toward the pivot frame and the printwheel drive ring 52. A restraining member (not shown) prevents the spring arm 98 from following the pivot frame as the pivot frame is moved by the interposer 16, in order to open the printwheel drive connection established between the drive ring 52 and the retainer button 54. The handle is retracted until the bearing surface 96 falls into the detent recess 100 on the interposer, thereby establishing a locking relationship between these two members and holding the connecting arm 456 in the collapsed position. This allows the operator to release the handle and manipulate the printwheel. Alternatively, the locking action may not be employed and the operator may hold the handle with one hand while removing and replacing the printwheel with the other.

An alternative embodiment for collapsing the push rod is shown in FIGS. 5 through 8. It includes a slider 104 supporting a roller support structure 106 at one end, to which are secured capturing rollers 34 and 36, and whose main body portion is retained for sliding movement in a groove 107 within a connecting arm 108. An elongated slot 109 in slider 104 receives pin 110, having a retaining head 112 extending from the connecting arm. Tabs 114, on the connecting arm together with the retaining head 112 hold the slider within the groove 107. A tension spring 115, secured at on end to the pin 110 and at its other end to the roller support structure 106, biases the end wall 116 of the slider toward a face cam 118 suitably mounted for rotation on the connecting arm. The cam has two opposed ramp surfaces 120 on which opposite sides of the end wall of the slider ride and a handle 122 extending outward therefrom for manipulation by the operator.

The connecting arm is mounted directly to the print tip 1ε and is provided with outboard pins 124 by which it is secured for relative rotational movement to the apex of the interposer 16. Tension spring 115 biases the connecting arm 108 toward the bail bar 26, because the slider is secured thereto, thereby maintaining intimate contact between the end wall 116 and the ramp surfaces 120. Thus, as the handle 122 is rotated in a counterclockwise direction from its position shown in FIG. 6 to its position shown in FIG. 7 (also from FIGS. 8A to 8B), the end wall 116 rides down the ramp and shortens the distance between the interposer and the bail bar. This action opens the throat and allows the operator access to the printwheel. In a manner similar to the operation of the FIG. 2 embodiment, the pivot frame is also drawn back and the printwheel is freed for removal and replacement.

It should be understood that the present disclosure has been made only by way of example, and that numerous changes in details of construction and the combination and arrangement of parts may be resorted to without departing from the true spirit and scope of the invention as hereinafter claimed.

What is claimed is:

1. An impact mechanism in an ipact printer, for delivering a printing force to drive a character element against a platen by means of a print tip normally spaced from the surface of said platen by a throat distance and movable a rockable bail bar having an axis of rotation substantially parallel to the axis of said platen, and constrained to limited angular movement toward and away from said platen, a prime mover connected to said bail bar for imparting the rocking movement thereto, a push rod comprised of a first portion connected to said bail bar and a second portion connected to said print tip for closing said throat distance and for delivering an impact force to said platen as said bail bar is moved toward said platen, said push rod is of a first length and is rigid for deliveringimpact forces to said platen and is collapsible to a second length, shorter than said first length, so as to be non-rigid and incapable of delivering an impact force, for drawing said print tip away from said platen by a distance greater than said throat distance so as to allow said character element to be removed, biasing means for urging said first and second portions together so as to shorten the overall length of said pushrod, and means for collapsing said push rod from said first length to said second length by overlapping said first and second portions.

2. The impact mechanism as defined in claim 1 wherein said character element is secured in driving engagement when said print tip is normally spaced by said throat distance, and including means connected to said push rod for releasing said printwheel from said driving engagement as said push rod is collapsed to said second length.

3. The impact mechanism as defined in claim 1 including latch means carried by said second portion which, when released, allows said biasing means to collapse said push rod.

4. The impact mechanism as defined in claim 3 wherein said latch means comprises a latch pin which when placed in interference relationship with said first portion prevents collapsing of said push rod, and which when moved out of said interference relationship allows said biasing means to collapse said push rod.

5. The impact mechanism as defined in claim 4 wherein said latch means further comprises a pivotable member supporting said latch pin at one end and having a handle at its other end so that manipulation of said handle will control the position of said latch pin.

6. The impact mechanism as defined in claim 1 wherein camming means is provided for collapsing said push rod.

7. The impact mechanism as defined in claim 6 wherein said camming means is a face cam including a pair of ramps and said first portion is urged against said ramps by said biasing means.

8. The impact mechanism as defined in claim 7 wherein said camming means is mounted upon said second portion for rotation, and further includes a handle extending radially outwardly thereof for rotating said camming means.

9. An impact mechanism in an impact printer, for delivering a printing force to drive a character element against a platen by means of a print tip normally spaced from the surface of said platen by a throat distance and movable toward and away from said platen, said character element and said print tip being supported upon a carriage mounted upon said printer for reciprocating movement in a path substantially parallel to the axis of said platen, including a rockable bail bar having having an axis of rotation substantially parallel to the axis of said platen, and constrained to limited angular movement toward and away from said platen, a prime mover connected to said bail bar for mparting the rocking movement thereto, a push rod interconnecting said print tip and said bail bar so as to close said throat distance for delivering an impact force to said platen as said bail bar is moved toward said platen, said push rod having a force receiving end connected to said bail bar and a force applying end connected to said print tip, means for drawing said force applying end and said print tip away from said platen to a distance greater than said throat distance so as to allow said character element to be removed, and wherein said push rod is of a first length and is rigid for delivering impact forces to said platen and is convertible to a second length, shorter than said first length, for drawing said print tip away from said platen to a distance greater than said throat distance.

* * * * *